US007719345B2

(12) United States Patent
Cho et al.

(10) Patent No.: US 7,719,345 B2
(45) Date of Patent: May 18, 2010

(54) REFERENCE BUFFER CIRCUITS

(75) Inventors: Yi-Hsien Cho, Taichung County (TW); Yu-Hsin Lin, Taipei (TW)

(73) Assignee: Mediatek Inc., Hsin-Chu (TW)

( * ) Notice: Subject to any disclaimer, the term of this patent is extended or adjusted under 35 U.S.C. 154(b) by 0 days.

(21) Appl. No.: 12/169,977

(22) Filed: Jul. 9, 2008

(65) Prior Publication Data

US 2008/0290934 A1 Nov. 27, 2008

Related U.S. Application Data

(63) Continuation-in-part of application No. 12/145,298, filed on Jun. 24, 2008.

(51) Int. Cl.
*G05F 1/10* (2006.01)

(52) U.S. Cl. ..... 327/538; 327/530; 327/540; 323/312

(58) Field of Classification Search ..... 327/530, 327/531, 538, 539, 540, 541; 323/312, 313
See application file for complete search history.

(56) References Cited

U.S. PATENT DOCUMENTS 5,443,003 A 8/1995 Larson
5,739,712 A * 4/1998 Fujii ..... 327/323
6,417,725 B1 7/2002 Aram et al.
6,509,858 B2 1/2003 Karanicolas
7,002,401 B2 * 2/2006 Khalid ..... 327/541
7,098,735 B2 8/2006 Ranganathan
2007/0090860 A1 * 4/2007 Hsu ..... 327/108

* cited by examiner

*Primary Examiner*—Lincoln Donovan
*Assistant Examiner*—Shikha Goyal
(74) *Attorney, Agent, or Firm*—Thomas, Kayden, Horstemeyer & Risley

(57) ABSTRACT

A reference buffer circuit is disclosed, providing a reference voltage at an output node and comprising a closed-loop branch comprising an amplifier and first and second MOS transistors and an open-loop branch comprising third and fourth MOS transistors and a tracking circuit. The first MOS transistor has a gate coupled to an output terminal of the amplifier and a source coupled to a negative input terminal of the amplifier. The second MOS transistor is coupled to the source of the first MOS transistor. The third MOS transistor has a gate coupled to the output terminal and a source coupled to the output node. The fourth MOS transistor has a drain coupled to the source of the third MOS transistor. A gate voltage of the fourth MOS transistor tracks a drain voltage of the third MOS transistor through the tracking circuit.

27 Claims, 11 Drawing Sheets

REFERENCE BUFFER CIRCUITS

CROSS REFERENCE TO RELATED APPLICATIONS

This application is a Continuation-In-Part of pending U.S. patent application Ser. No. 12/145,298, filed Jun. 24, 2008 and entitled "REFERENCE BUFFER CIRCUITS", the contents of which are incorporated herein by reference.

BACKGROUND OF THE INVENTION

1. Field of the Invention

The invention relates to a reference buffer circuit, and more particularly to a reference buffer circuit for providing at least one reference voltage to an analog-to-digital converter, regulator or the like.

2. Description of the Related Art

Reference buffer circuits are required for high-speed and high-resolution analog-to-digital converters (ADCs). A reference buffer circuit usually comprises a reference buffer and provides at least one reference voltage to an ADC. There are two types of reference buffer circuits available for ADCs: closed-loop reference buffer circuits and open-loop reference buffer circuits.

FIG. 1 shows a conventional closed-loop reference buffer circuit 1. An amplifier 10 has a negative feedback loop. The amplifier 10 receives an input voltage Vref_in at a positive input terminal and outputs a reference voltage Vref. The output impedance of the reference buffer circuit 1 is equal to $R_{OUT}/(1+A)$, wherein $R_{OUT}$ represents the output impedance of the amplifier 10, and A represents the gain thereof. When the reference buffer circuit 1 operates at a high frequency, the output impedance of the reference buffer circuit 1 is required to be low enough to rapidly stabilize the reference voltage Vref. However, the wide bandwidth causes the power consumption and noise of the reference buffer circuit 1 to be increased. It is difficult to design an internal closed-loop reference buffer circuit for a high-resolution ADC.

FIG. 2 shows a conventional single-ended open-loop reference buffer circuit. A single-ended open-loop reference buffer circuit 2 comprises an amplifier 20, N-type metal oxide semiconductor (NMOS) transistors 21 and 22, and load units 23 and 24. The operation of the NMOS transistor 22 is similar to the NMOS transistor 21. The amplifier 20 and the NMOS transistor 21 form a negative feedback loop, while the NMOS transistor 22 is disposed in an open-loop circuit. In steady state, reference voltage Vref tracks reference voltage Vrefx. Moreover, the output impedance of the open-loop reference buffer circuit 2 is equal to 1/gm, wherein gm represents the transconductance of the NMOS transistor 22, and the bandwidth of the amplifier 20 can be narrower, the power consumption of the open-loop reference buffer circuit 2 is less than that of the closed-loop reference buffer circuit 1 as illustrated in FIG. 1.

FIG. 3 shows a conventional differential open-loop reference buffer circuit. A differential open-loop reference buffer circuit 3 comprises amplifiers 30 and 31, NMOS transistors 32 and 33, P-type metal oxide semiconductor (PMOS) transistors 34 and 35, and resistors 36 and 37. Positive input terminals of the amplifiers 30 and 31 respectively receive input voltages Vrefp_in and Vrefn_in. The amplifier 30 and the NMOS transistor 32 form one negative feedback loop, and the amplifier 31 and the PMOS transistor 34 form the other negative feedback loop. The NMOS transistor 33 is disposed in one open-loop circuit, and the PMOS transistor 35 is disposed in the other open-loop circuit. In steady state, reference voltages Vrefp and Vrefn respectively track reference voltages Vrefpx and Vrefnx.

In FIG. 2, there is a voltage difference between the gate and the source of each of the NMOS transistors 21 and 22 which are both operated in saturation region, and the voltage of an output terminal of the amplifier 20 is larger than the reference voltage Vrefx by the voltage difference, so that a required supply voltage of the open-loop reference buffer circuit 2 is large. If the open-loop reference buffer circuit 2 operates under a low supply voltage due to design requirements, the maximum value of the reference voltage Vref is suppressed to be small. Similarly, in FIG. 3, there is a voltage difference between the gate and the source of each of the NMOS transistors 32 and 33 and there is a voltage difference between the gate and the source of each of the PMOS transistors 34 and 35, and the maximum value of the reference voltage Vrefp and the minimum values of the reference voltage Vrefn are limited when the open-loop reference buffer circuit 3 operates under a low supply voltage, so that the swing between the reference voltages Vrefp and Vrefn is hard to meet design requirements.

With the advancement of semiconductor processes, the operation voltage of semiconductors decreases. Thus, a reference buffer circuit, which can operate under low supply voltage, can provide reference voltages with large swing, and has less power consumption and high operation speed, is required.

BRIEF SUMMARY OF THE INVENTION

An exemplary embodiment of a reference buffer circuit provides a reference voltage at an output node and comprises a closed-loop branch and an open-loop branch. The closed-loop branch comprises an amplifier, a first metal oxide semiconductor (MOS) transistor, and a second MOS transistor, and the open-loop branch comprises a third MOS transistor, a fourth MOS transistor, and a first tracking circuit. The amplifier has a positive input terminal for receiving an input voltage, a negative input terminal, and an output terminal. The first MOS transistor has a gate coupled to the output terminal of the amplifier, a source coupled to the negative input terminal of the amplifier, and a drain. The second MOS transistor is coupled to the source of the first MOS transistor. The third MOS transistor has a gate coupled to the output terminal of the amplifier, a source coupled to the output node, and a drain. The fourth MOS transistor has a drain coupled to the source of the third MOS transistor, a source, and a gate. The first tracking circuit, coupled between the drain of the third MOS transistor and the gate of the fourth MOS transistor, is arranged to make a voltage of the gate of the fourth MOS transistor track a voltage of the drain of the third MOS transistor.

Another exemplary embodiment of a reference buffer circuit provides a reference voltage at an output node and comprises a closed-loop branch and an open-loop branch. The closed-loop branch comprises an amplifier, a source-follower transistor, and a first current transistor, and the open-loop branch comprises a driving transistor, a second current transistor, a first current source, and a first tracking transistor. The amplifier has a positive input terminal for receiving an input voltage, a negative input terminal, and an output terminal. The source-follower transistor has a gate coupled to the output terminal of the amplifier, a source coupled to the negative input terminal of the amplifier, and a drain. The first current transistor is coupled to the source of the source-follower transistor. The driving transistor has a gate coupled to the output terminal of the amplifier, a source coupled to the output node, and a drain. The second current transistor has a drain coupled to the source of the driving transistor, a source, and a gate. The first current source is coupled to the gate of the second current transistor. The first tracking transistor has a gate for receiving a bias voltage, a source coupled to the drain of the driving transistor, and a drain coupled to the gate of the second current transistor.

Another exemplary embodiment of a reference buffer circuit provides a first reference voltage at a first output node and a second reference voltage at a second output node and comprises a closed-loop branch and an open-loop branch. The closed-loop branch comprises a first amplifier, a second amplifier, a first metal oxide semiconductor transistor, a second MOS transistor, and a third MOS transistor. The open-loop branch comprises a fourth MOS transistor, a fifth MOS transistor, a sixth MOS transistor, and a first tracking circuit. The first amplifier has a positive input terminal for receiving a first input voltage, a negative input terminal, and an output terminal. The second amplifier has a positive input terminal for receiving a second input voltage, a negative input terminal, and an output terminal). The first MOS transistor has a gate coupled to the output terminal of the first amplifier, a source coupled to the negative input terminal of the first amplifier, and a drain. The second MOS transistor has a gate coupled to the output terminal of the second amplifier, a source coupled to the negative input terminal of the second amplifier, and a drain coupled to the drain of the first MOS transistor. The third MOS transistor is coupled to the source of the second MOS transistor. The fourth MOS transistor has a gate coupled to the output terminal of the first amplifier, a source coupled to the first output node (Noutp), and a drain. The fifth MOS transistor has a gate coupled to the output terminal of the second amplifier, a source coupled to the second output node, and a drain coupled to the drain the fourth MOS transistor. The sixth MOS transistor has a drain coupled to the source of the fifth MOS transistor, a source, and a gate. The first tracking circuit is arranged to make a voltage of the gate of the sixth MOS transistor track a voltage of the drain of the fifth MOS transistor.

Another exemplary embodiment of a reference buffer circuit provides a first reference voltage at a first output node and a second reference voltage at a second output node and comprises a closed-loop branch and an open-loop branch. The closed-loop branch comprises a first amplifier, a second amplifier, a first source-follower transistor, a second source-follower transistor, and a first current transistor. The open-loop branch comprises a first driving transistor, a second driving transistor, a second current transistor, and a first tracking transistor. The first amplifier has a positive input terminal for receiving a first input voltage, a negative input terminal, and an output terminal. The second amplifier has a positive input terminal for receiving a second input voltage, a negative input terminal, and an output terminal. The first source-follower transistor has a gate coupled to the output terminal of the first amplifier, a source coupled to the negative input terminal of the first amplifier, and a drain. The second source-follower transistor has a gate coupled to the output terminal of the second amplifier, a source coupled to the negative input terminal of the second amplifier, and a drain coupled to the drain of the first source-follower transistor. The first current transistor is coupled to the source of the second source-follower transistor. The first driving transistor has a gate coupled to the output terminal of the first amplifier, a source coupled to the first output node, and a drain. The second driving transistor has a gate coupled to the output terminal of the second amplifier, a source coupled to the second output node (Noutn), and a drain coupled to the drain of the first driving transistor. The second current transistor is coupled to the source of the second driving transistor. The first current source is coupled to the gate of the second current transistor. The first tracking transistor has a gate for receiving a bias voltage, a source coupled to the drain of the second driving transistor, and a drain coupled to the gate of the second current transistor.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
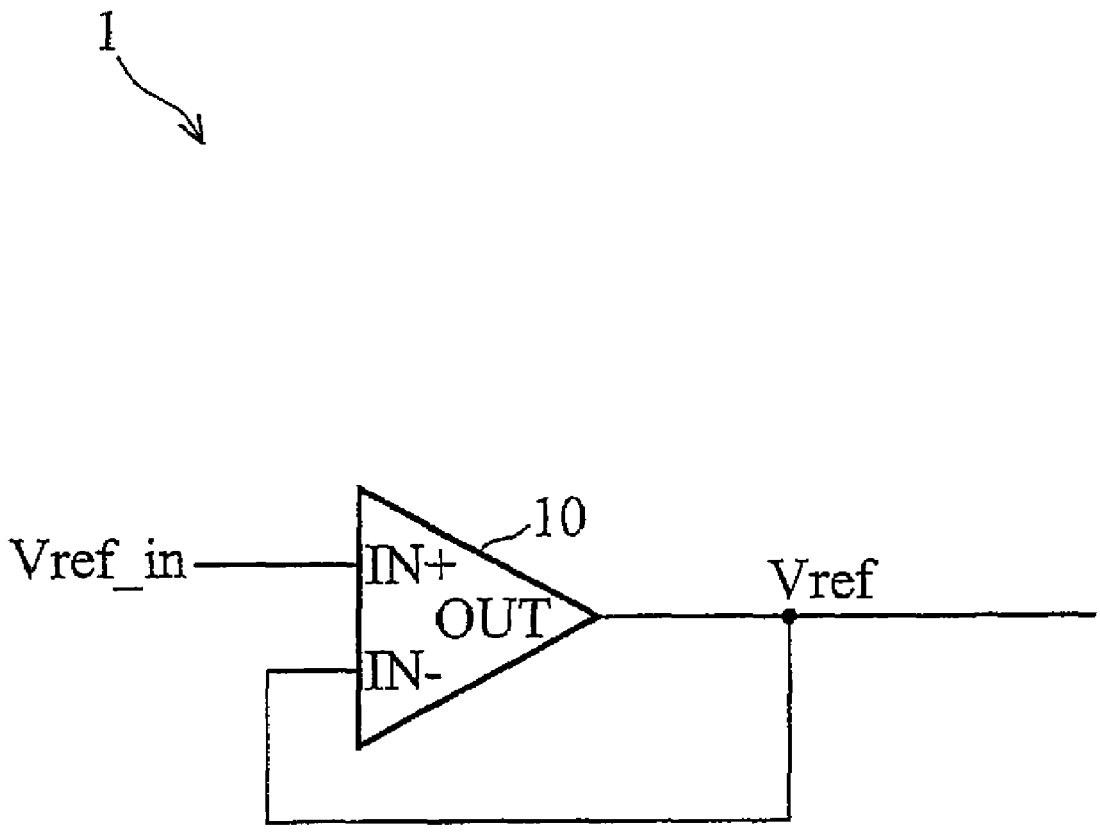
FIG. 1 ( RELATED ART )
FIG. 1 shows a conventional basic closed-loop reference buffer circuit.
Figure 2:
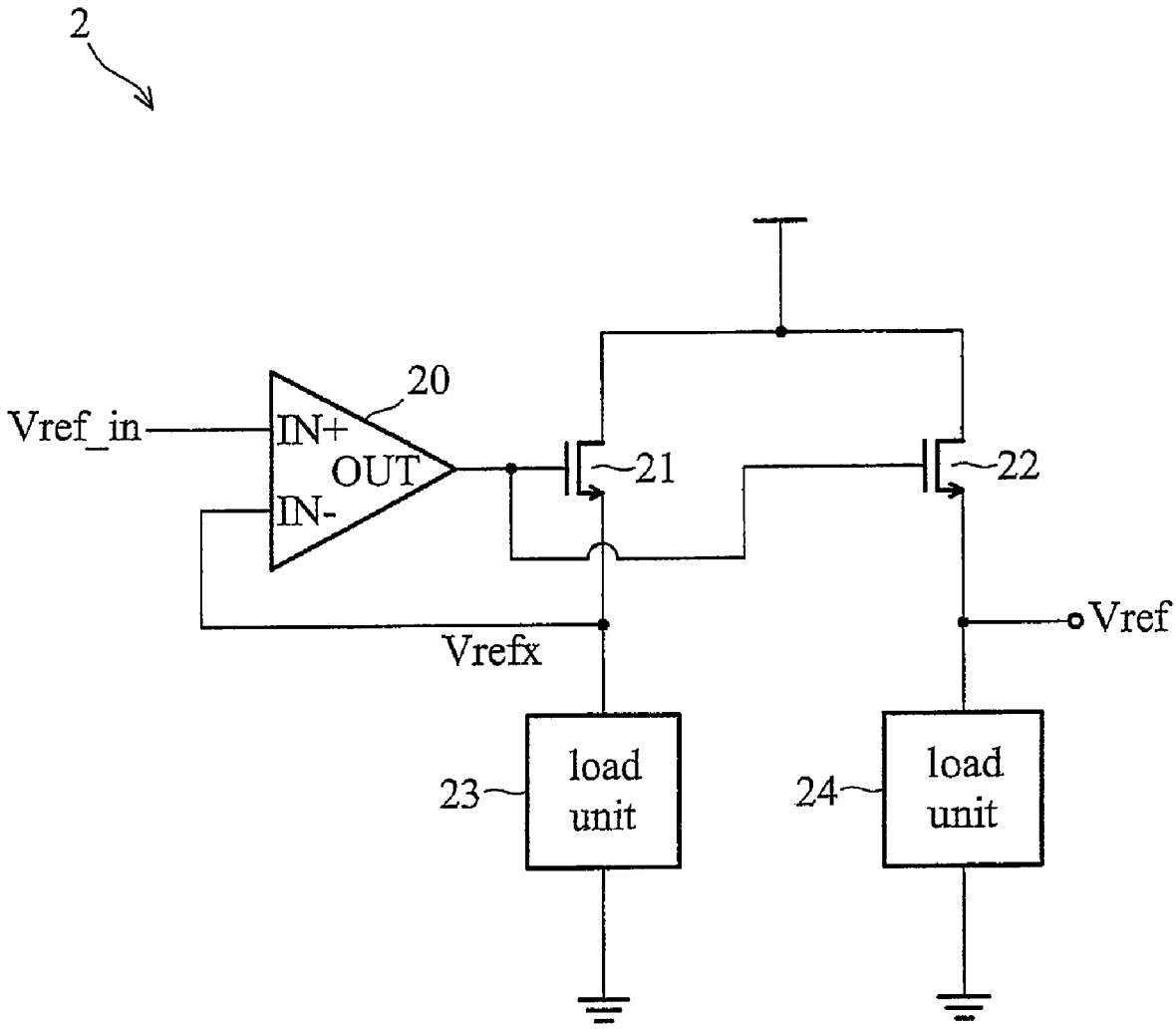
FIG. 2 ( RELATED ART )
FIG. 2 shows a conventional single-ended open-loop reference buffer circuit.
Figure 3:
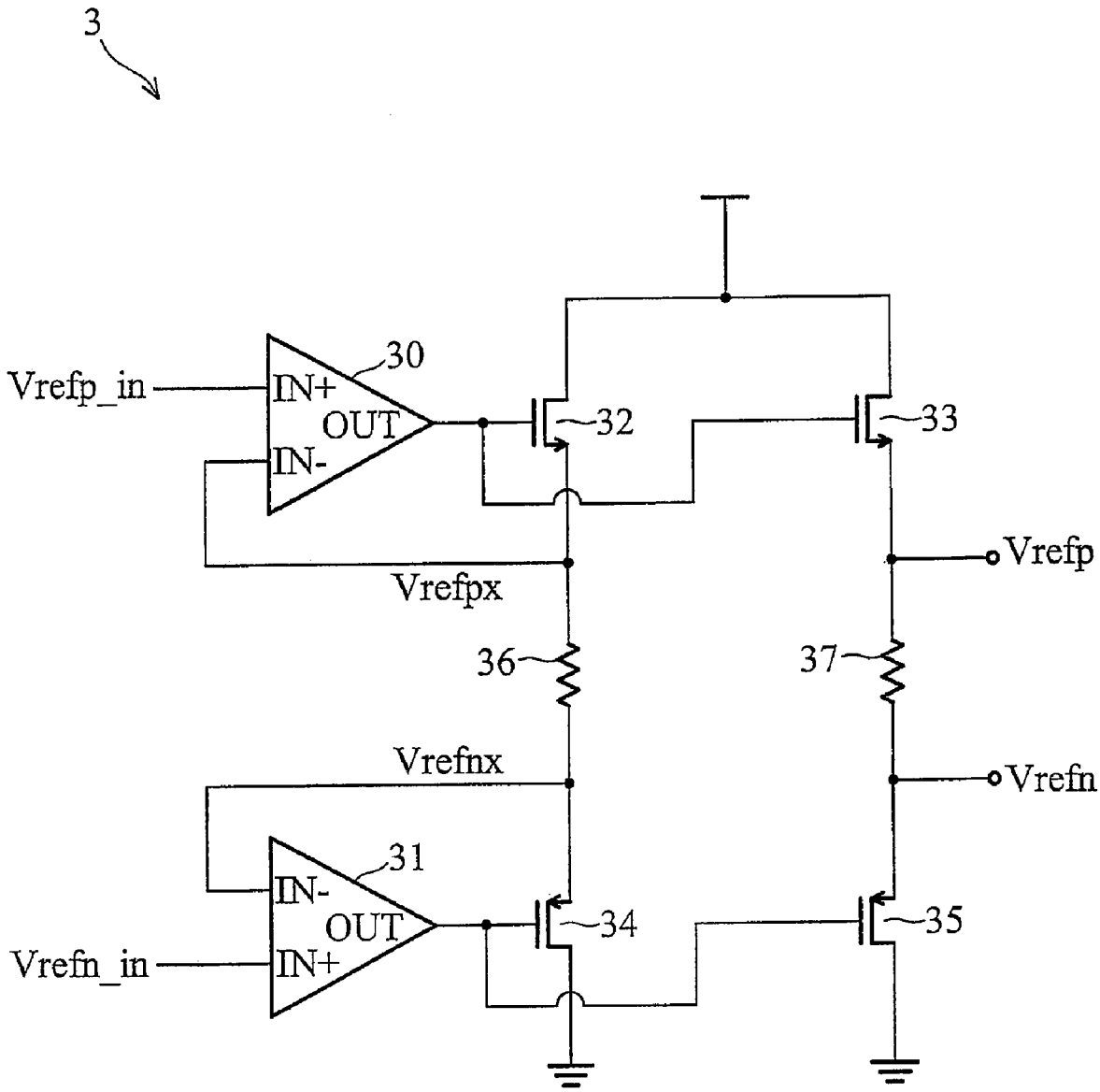
FIG. 3 ( RELATED ART )
FIG. 3 shows a conventional differential open-loop reference buffer circuit.
Figure 4:
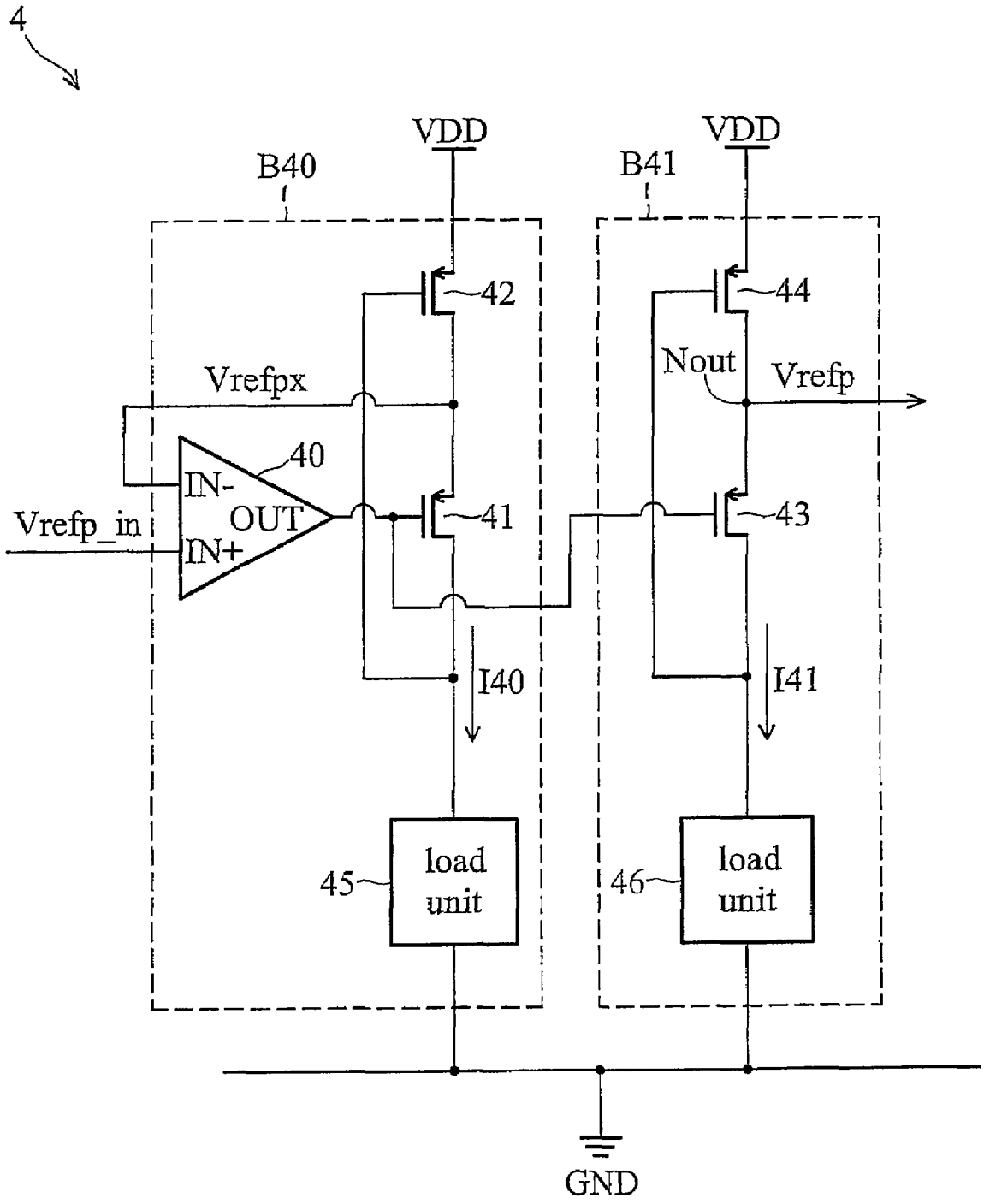
FIG. 4 shows an exemplary embodiment of a reference buffer circuit.

In an exemplary embodiment of a reference buffer circuit in FIG. 4, a single-ended reference buffer circuit 4 generates a reference voltage Vrefp at an output node Nout and comprises an amplifier 40, a P-type metal oxide semiconductor (PMOS) source-follower transistor 41, a PMOS driving transistor 43, PMOS current transistors 42 and 44, and load units 45 and 46. That is, in the single-ended reference buffer circuit 4, a closed-loop branch B40 comprises the amplifier 40, the PMOS transistors 41 and 42, and the load unit 45, and an open-loop branch B41 comprises the PMOS transistors 43 and 44 and the load unit 46.

In the closed-loop branch B40, a positive input terminal IN+ of the amplifier 40 receives an input voltage Vrefp_in. A gate of the PMOS transistor 41 is coupled to an output terminal OUT of the amplifier 40, and a source of the PMOS transistor 41 is coupled to a negative input terminal IN− of the amplifier 40. A gate of the PMOS transistor 42 is coupled to a drain of the PMOS transistor 41, a source of the PMOS transistor 42 is coupled to a supply voltage source VDD, and a drain of the PMOS transistor 42 is coupled to the source of the PMOS transistor 41. The load unit 45 is coupled between the drain of the PMOS transistor 41 and a low voltage source, such as signal ground GND.

In the open-loop branch B41, a gate of the PMOS transistor 43 is coupled the output terminal OUT of the amplifier 40, and a source of the PMOS transistor 43 is coupled to the output node Nout. A gate of the PMOS transistor 44 is coupled to the drain of the PMOS transistor 43, a source of the PMOS transistor 44 is coupled to the supply voltage source VDD, and a drain of the PMOS transistor 44 is coupled to the output node Nout. The load unit 46 is coupled between the drain of the PMOS transistor 43 and the signal ground GND.

While operating, a current I40 and a reference voltage Vrefpx are generated in the closed-loop branch B40, and a current I41 and a reference voltage Vrefp are generated in the open-loop branch B41. The current I41 is typically N times the current I40 for ensuring the driving ability of the reference buffer circuit 4. Thus, the size of the PMOS transistor 43 is N times the size of the PMOS transistor 41, and the size of the PMOS transistor 44 is N times the size of the PMOS transistor 42. The impedance of the load unit 45 is N times the impedance of the load unit 46. In this embodiment, the size of each transistor can be a respective width-length ratio (W/L). Moreover, the load units 45 and 46 can be implemented by transistors or resistors. For example, if the load units 45 and 46 are implemented by resistors, the resistance value of the load unit 45 is N times the resistance value of the load unit 46. If the load units 45 and 46 are implemented by transistors, the size of the load unit 46 is N times the size of the load unit 45. According to the above circuit structure, the reference voltage Vrefp tracks the reference voltage Vrefpx, and the PMOS current transistors 42 and 44 act as current sources.

In the embodiment of FIG. 4, the maximum value of the reference voltage Vrefp is equal to about (vdd−|vds|), wherein vdd represents the voltage value provided by the supply voltage source VDD, and vds represents the voltage difference between the drain and the source of the PMOS transistor 44. The reference voltage Vrefp is not limited by the voltage difference between the gate and the source of the PMOS transistor 41 or 43, which is operated in saturation region and coupled to the output terminal OUT of the amplifier 40, and the reference buffer circuit 4 therefore can normally operate even under a very low supply voltage provided by the supply voltage source VDD. Moreover, the output impedance of the reference buffer circuit 4 is substantially equal to 1/gm so as to rapidly stabilize the reference voltage Vrefp, and the bandwidth of the amplifier 40 is not so required, therefore, the power consumption of the reference buffer circuit 4 can be more decreased.

Figure 5:
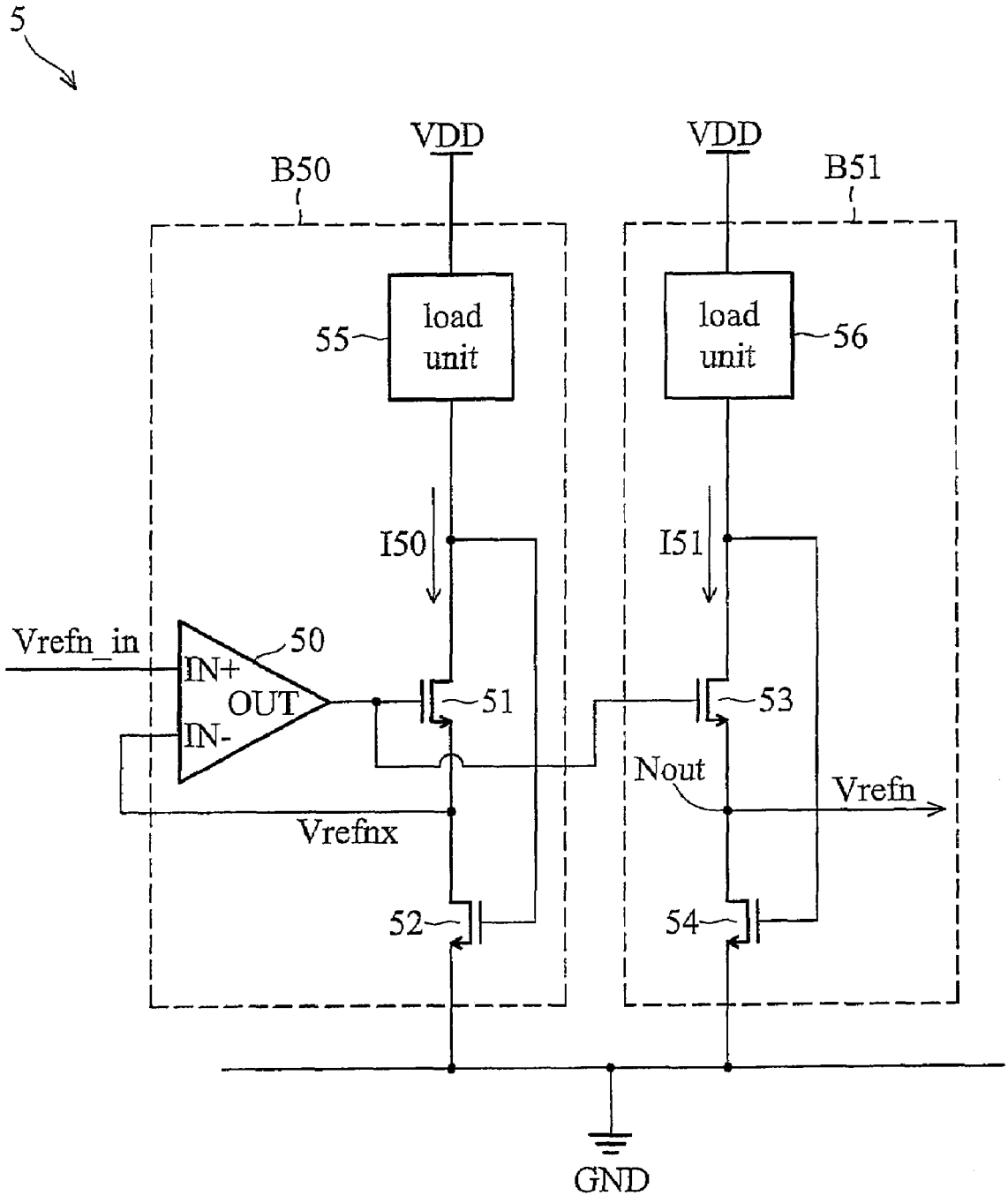
FIG. 5 shows another exemplary embodiment of a single-ended reference buffer circuit.

FIG. 5 shows another exemplary embodiment of a single-ended reference buffer circuit. A single-ended reference buffer circuit 5 generates a reference voltage Vrefn at an output node Nout and comprises an amplifier 50, an NMOS source-follower transistor 51, an NMOS driving transistor 53, NMOS current transistors 52 and 54, and load units 55 and 56. That is, in the single-ended reference buffer circuit 5, a closed-loop branch B50 comprises the amplifier 50, the NMOS transistors 51 and 52, and the load unit 55, and an open-loop branch B51 comprises the NMOS transistors 53 and 54 and the load unit 56. A source of the NMOS transistor 53 is coupled to a drain of the NMOS transistor 54 at the output node Nout. While operating, a current I50 and a reference voltage Vrefnx are generated in the closed-loop branch B50, and a current I51 and a reference voltage Vrefn are generated in the open-loop branch B51. The current I51 is typically N times the current ISO for ensuring the driving ability of the reference buffer circuit 5. Thus, the size of the NMOS transistor 53 is N times the size of the NMOS transistor 51, and the size of the NMOS transistor 54 is N times the size of the NMOS transistor 52. The impedance of the load unit 55 is N times the impedance of the load unit S6. In this embodiment, the size of each transistor can be a respective width-length ratio (W/L). Moreover, the load units 55 and 56 can be implemented by transistors or resistors. For example, if the load units 55 and 56 are implemented by resistors, the resistance value of the load unit 55 is N times the resistance value of the load unit 56. If the load units 55 and 56 are implemented by transistors, the size of the load unit 56 is N times the size of the load unit 55. According to the above circuit structure, the reference voltage Vrefn tracks the reference voltage Vrefnx, and the NMOS current transistors 52 and 54 act as current sinks.

In the embodiment of FIG. 5, the minimum value of the reference voltage Vrefn is equal to about |vds|, wherein vds represents the voltage difference between the drain and the source of the NMOS transistor 54. The reference voltage Vrefn is not limited by the voltage difference between the gate and the source of the NMOS transistor 51 or 53, which is operated in saturation region and coupled to the output terminal OUT of the amplifier 50, and the reference buffer circuit 5 therefore can normally operate even under a very low supply voltage provided by the supply voltage source VDD. Moreover, the output impedance of the reference buffer circuit 5 is substantially equal to 1/gm so as to rapidly stabilize the reference voltage Vrefn, and the bandwidth of the amplifier 50 is not so required, therefore, the power consumption of the reference buffer circuit 5 can be more decreased.

Figure 6:
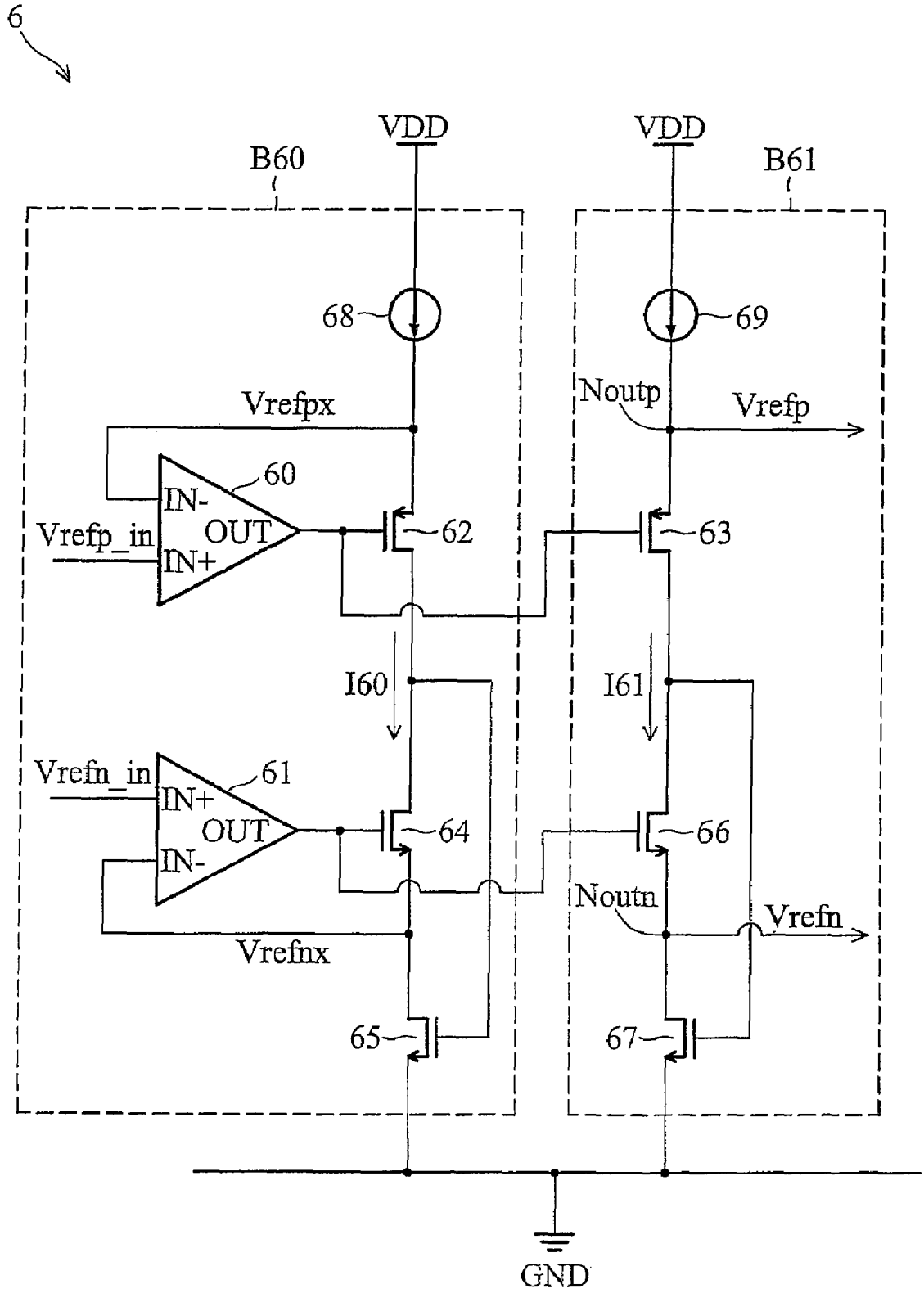
FIG. 6 shows an exemplary embodiment of a differential reference buffer circuit.

FIG. 6 shows an exemplary embodiment of a differential reference buffer circuit. A differential reference buffer circuit 6 generates reference voltages Vrefp and Vrefn respectively at output nodes Noutp and Noutn and comprises amplifiers 60 and 61, a PMOS source-follower transistor 62, a PMOS driving transistor 63, an NMOS source-follower transistor 64, an NMOS driving transistor 66, NMOS current transistors 65 and 67, and current sources 68 and 69. That is, in the differential reference buffer circuit 6, a closed-loop branch B60 comprises the amplifiers 60 and 61, the PMOS transistor 62, the NMOS transistors 64 and 65, and the current source 68, and an open-loop branch B61 comprises the PMOS transistor 63, the NMOS transistors 66 and 67, and the current source 69.

In the closed-loop branch B60, a positive input terminal IN+ of the amplifier 60 receives an input voltage Vrefp_in, and a positive input terminal IN+ of the amplifier 61 receives an input voltage Vrefn_in. A gate of the PMOS transistor 62 is coupled to an output terminal OUT of the amplifier 60, and a source of the PMOS transistor 62 is coupled to a negative input terminal IN− of the amplifier 60. A gate of the NMOS transistor 64 is coupled to an output terminal OUT of the amplifier 61, a source of the NMOS transistor 64 is coupled to a negative input terminal IN− of the amplifier 61, and a drain of the NMOS transistor 64 is coupled to a drain of the PMOS transistor 62. A gate of the NMOS transistor 65 is coupled to the drain of the NMOS transistor 64, a source of the NMOS transistor 65 is coupled to a low voltage source, such as signal ground GND, and a drain of the NMOS transistor 65 is coupled to the source of the NMOS transistor 64. The current source 68 is coupled between the source of the PMOS transistor 62 and a supply voltage source VDD.

In the open-loop branch B61, a gate of the PMOS transistor 63 is coupled to the output terminal OUT of the amplifier 60, and a source of the PMOS transistor 63 is coupled to the output node Noutp. A gate of the NMOS transistor 66 is coupled to the output terminal OUT of the amplifier 61, a source of the NMOS transistor 66 is coupled to the output node Noutn, and a drain of the NMOS transistor 66 is coupled to a drain of the PMOS transistor 63. A gate of the NMOS transistor 67 is coupled to the drain of the NMOS transistor 66, a source of the NMOS transistor 67 is coupled to the signal ground GND, and a drain of the NMOS transistor 67 is coupled to the output node Noutn. The current source 69 is coupled between the source of the PMOS transistor 63 and the supply voltage source VDD.

While operating, a current I60 and reference voltages Vrefpx and Vrefnx are generated in the closed-loop branch B60, and a current I61 and reference voltages Vrefp and Vrefn are generated in the open-loop branch B61. The current I61 is typically N times the current I60 for ensuring the driving ability of the reference buffer circuit 6. Thus, the size of each of the transistors 63, 66, and 67 is N times the size of the corresponding one of the transistors 62, 64, and 65. In this embodiment, the size of each transistor can be a respective width-length ratio (W/L). Moreover, the current sources 68 and 69 can be implemented by transistors. For example, if the current sources 68 and 69 are implemented by transistors, the size of the current source 69 is N times of the size of the current source 68. According to the above circuit structure, the reference voltage Vrefp tracks the reference voltage Vrefpx, and the reference voltage Vrefn tracks the reference voltage Vrefnx. Moreover, the NMOS current transistors 65 and 67 act as current sinks.

In the embodiment of FIG. 6, the reference voltages Vrefp and Vrefn are not limited by the voltage differences between the gate and the source of each of the transistors 62, 63, 64, and 66, which are operated in saturation region and coupled to the output terminals OUT of the amplifiers 60 and 61, such that the reference buffer circuit 6 can normally operate under a very low supply voltage provided by the supply voltage source VDD, and the swing between the reference voltages Vrefp and Vrefn can become relatively large. For example, if the current sources 68 and 69 are respectively implemented by MOS transistors, the maximum value of the reference voltage Vrefp is equal to about (vdd−|vds|), the minimum value of the reference voltage Vrefn is equal to about |vds|, and the swing between of the reference voltages Vrefp and Vrefn is therefore equal to (vdd−2|vds|), wherein vdd represents the voltage value provided by the supply voltage source VDD, and vds represents the voltage difference between the drain and the source of each of the transistor 67 and the MOS transistor in the current source 69. Moreover, the output impedance of the reference buffer circuit 6 is substantially equal to 1/gm so as to rapidly stabilize the reference voltages Vrefp and Vrefn, and the bandwidth of the amplifiers 60 and 61 is not so required, therefore, the power consumption of the reference buffer circuit 6 can be more decreased.

Figure 7:
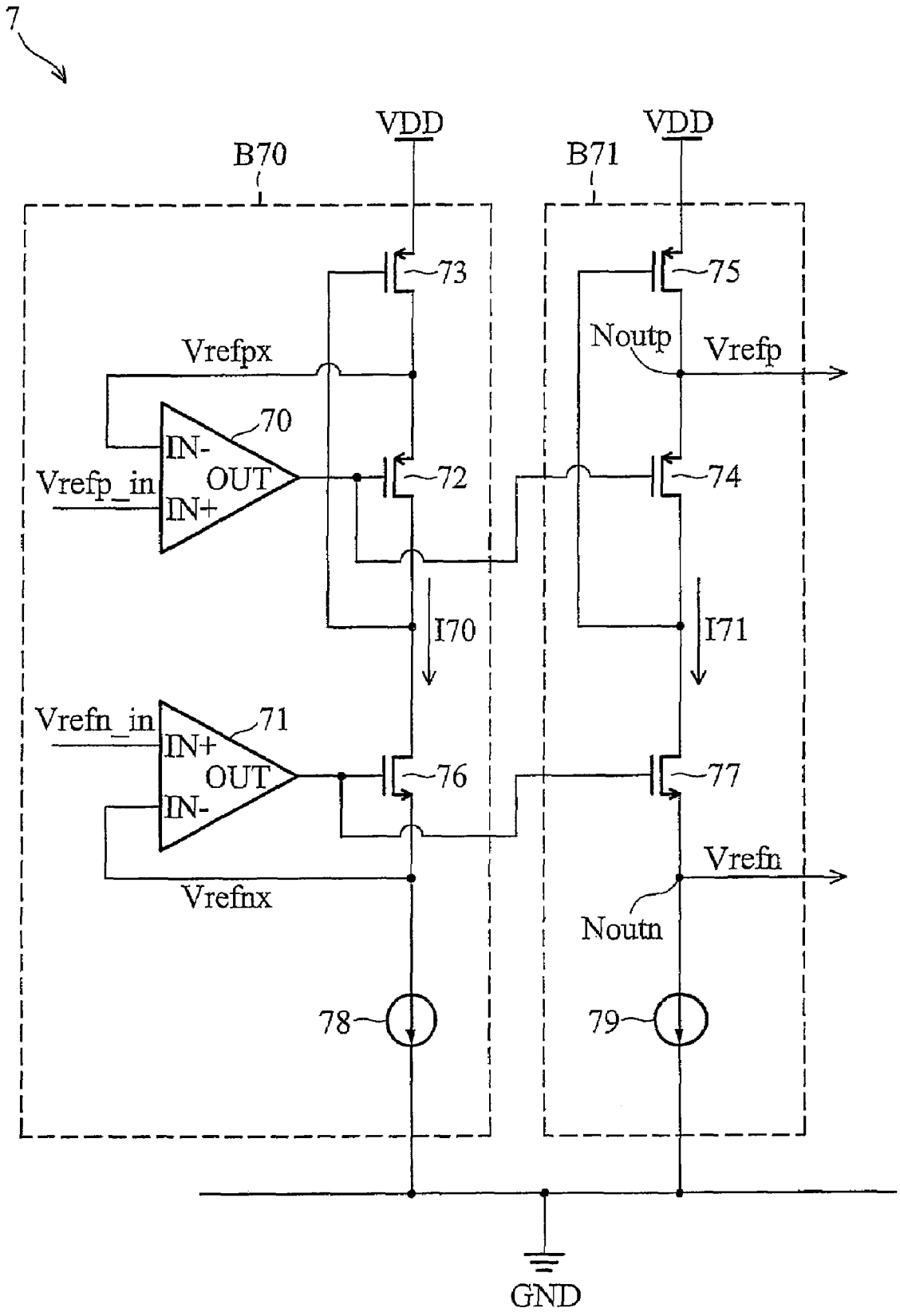
FIG. 7 shows another exemplary embodiment of a differential reference buffer circuit.

FIG. 7 shows another exemplary embodiment of a differential reference buffer circuit. A differential reference buffer circuit 7 generates reference voltages Vrefp and Vrefn respectively at output nodes Noutp and Noutn and comprises amplifiers 70 and 71, a PMOS source-follower transistor 72, PMOS current transistors 73 and 75, a PMOS driving transistor 74, an NMOS source-follower transistor 76, an NMOS driving transistor 77, and current sources 78 and 79. That is, in the differential reference buffer circuit 7, a closed-loop branch B70 comprises the amplifiers 70 and 71, the PMOS transistors 72 and 73, the NMOS transistor 76, and the current source 78, and an open-loop branch B71 comprises the PMOS transistors 74 and 75, the NMOS transistor 77, and the current source 79. A source of the PMOS transistor 74 is coupled to a drain of the PMOS transistor 75 at an output node Noutp, and a source of the NMOS transistor 77 is coupled to the current source 79 at an output node Noutn.

Referring to FIG. 7, a current I70 and reference voltages Vrefpx and Vrefnx are generated in the closed-loop branch B70, and a current I71 and reference voltages Vrefp and Vrefn are generated in the open-loop branch B71. The current I71 is typically N times the current I70 for ensuring the driving ability of the reference buffer circuit 7. Thus, the size of each of the transistors 74, 75, and 77 is N times the size of the corresponding one of the transistors 72, 73, and 76. In this embodiment, the size of each transistor can be a respective width-length ratio (W/L). Moreover, the current sources 78 and 79 can be implemented by transistors. For example, if the current sources 78 and 79 are implemented by transistors, the size of the current source 79 is N times the size of the current source 78. According to the above circuit structure, the reference voltage Vrefp tracks the reference voltage Vrefpx, and the reference voltage Vrefn tracks the reference voltage Vrefnx. Moreover, the NMOS current transistors 73 and 75 act as current sources.

In the embodiment of FIG. 7, the reference voltages Vrefp and Vrefn are not limited by the voltage difference between the gate and the source of each of the transistors 72, 74, 76, and 77, which are operated in saturation region and coupled to the output terminals OUT of the amplifiers 70 and 71, such that the reference buffer circuit 7 can normally operate under a very low supply voltage provided by the supply voltage source VDD, and the swing between the reference voltages Vrefp and Vrefn can become relatively large. Moreover, the output impedance of the reference buffer circuit 7 is substantially equal to 1/gm so as to rapidly stabilize the reference voltages Vrefp and Vrefn, and the bandwidth of the amplifiers 70 and 71 is not so required, therefore, the power consumption of the reference buffer circuit 7 can be more decreased.

According to the above embodiments, the disclosed reference buffer circuits can normally operate under a low supply voltage without limitation for outputting the reference voltages, so that the swing between the reference voltages can be relatively larger. Moreover, due to the open-loop branches configured in the reference buffer circuits, the reference buffer circuits can rapidly stabilize the reference voltages Vrefp and Vrefn and have less power consumption.

Figure 8:
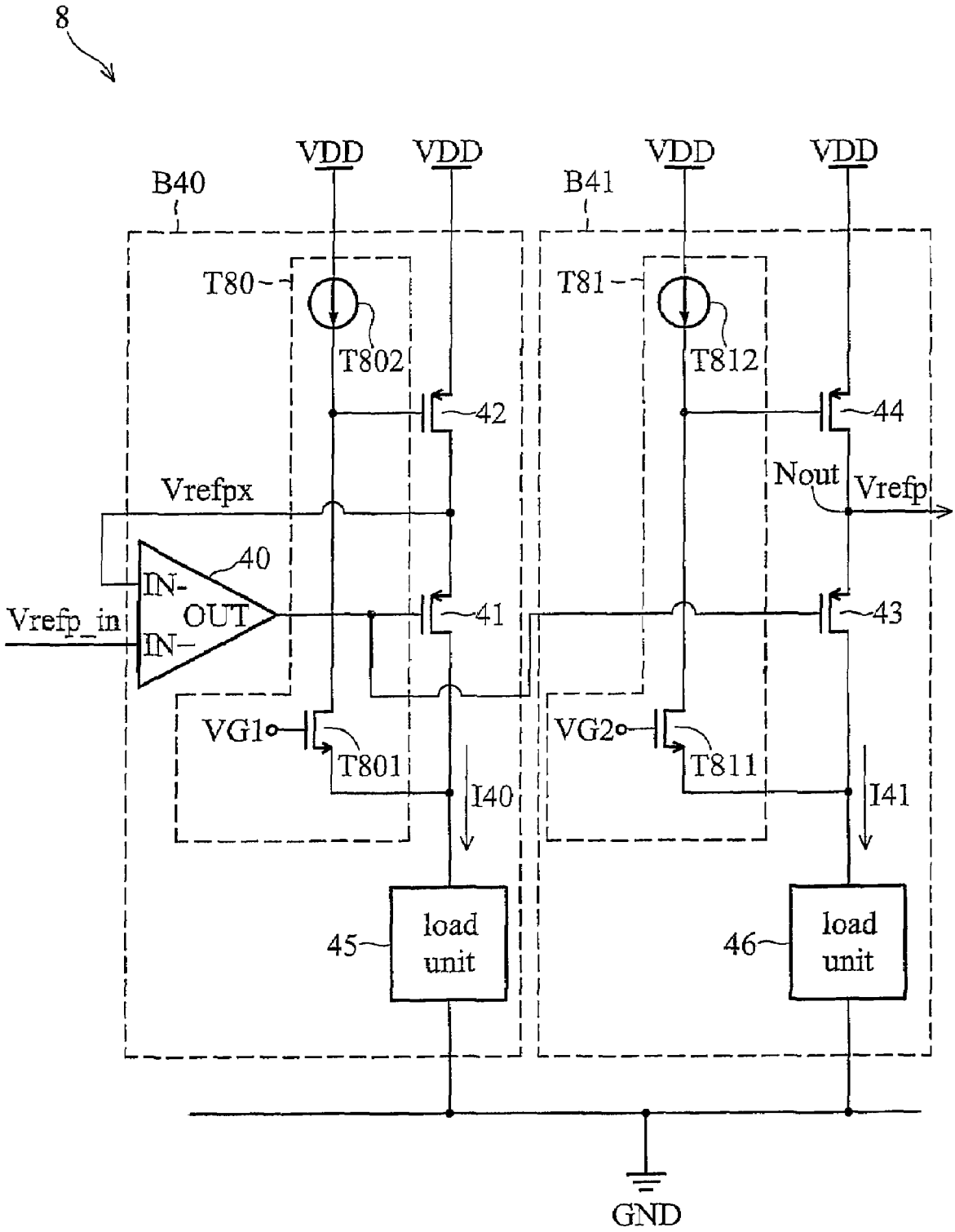
FIG. 8 shows another exemplary embodiment of a reference buffer circuit.

In some conditions, for example in the reference buffer circuit 4 in FIG. 4, a following device subsequent to the reference buffer circuit 4 requires a large current from the output node Nout. Accordingly, another exemplary embodiment of a reference buffer circuit is provided, achieving a greater current-driving capability. In an exemplary embodiment of a single-ended reference buffer circuit 8 in FIG. 8, a majority of the elements and their connections are similar with the reference buffer circuit 4 of FIG. 4, and the connection between the gate of the PMOS transistor 44 and the drain of the PMOS transistor 43 and the connection between the gate of the PMOS transistor 42 and the drain of the PMOS transistor 41 are modified. Referring to FIG. 8, there is a tracking circuit T81 coupled between the gate of the PMOS transistor 44 and the drain of the PMOS transistor 43. The tracking circuit T81 comprises a tracking NMOS transistor T811 and a current source T812. The current source T812 is coupled between the voltage source VDD and the gate of the PMOS transistor 44. A gate of the NMOS transistor T811 receives a bias voltage VG2 (for example, to be operated in a saturation region), a source of the NMOS transistor T811 is coupled to the drain of the PMOS transistor 43, and a drain of the NMOS transistor T811 is coupled to the gate of the PMOS transistor 44. When a large current is required from the output node Nout by the following device, the voltages of the source and drain of the PMOS transistor 43 (e.g. Vrefp) are firstly decreased, and the PMOS transistor 43 thus enters a triode region such that the voltage of its drain is also decreased. A current flowing through the NMOS transistor T811 is increased due to the increased gate-source voltage of the NMOS transistor T811, so that a voltage of the drain of the NMOS transistor T811 is decreased. In other words, a voltage of the gate of the PMOS transistor 44 can be regarded as being decreased by tracking the decreased voltage of the drain of the PMOS transistor 43 through the NMOS transistor T811. Then, a current flowing through the PMOS transistor 44 is increased since the source-gate voltage of the PMOS transistor 44 is increased by the decreased voltage of its gate. As a result, the large current which is required by the following device can be rapidly compensated by the current sequentially provided from the PMOS transistor 44 in response to the voltage drop at the output node Nout as stated above. After that, the PMOS transistor 43 eventually returns to the saturation region. When the following device stops requiring the such large current, the voltage of the drain of the PMOS transistor 43 is firstly increased, and the voltage of the gate of the PMOS transistor 44 is increased by tracking the increased voltage of the drain of the PMOS transistor 43 through the NMOS transistor T811, so that the current flowing through the PMOS transistor 44 can be decreased.

Similarly, referring to FIG. 8, there is a tracking circuit T80 coupled between the gate of the PMOS transistor 42 and the drain of the PMOS transistor 41. The tracking circuit T80 comprises a tracking NMOS transistor T801 and a current source T802. The current source T802 is coupled between the voltage source VDD and the gate of the PMOS transistor 42. A gate of the NMOS transistor T801 receives a bias voltage VG1 (for example, to be operated in a saturation region), a source of the NMOS transistor T801 is coupled to the drain of the PMOS transistor 41, and a drain of the NMOS transistor T801 is coupled to the gate of the PMOS transistor 42. According to the above description, the voltage of the gate of the PMOS transistor 42 tracks the voltage of the drain of the PMOS transistor 41 through the NMOS transistor T811 to adjust the current flowing through the PMOS transistor 42. Thus, the transistors 41 and 43 can substantially operate in the saturation region. The reference voltage Vrefp can also accurately track the reference voltage Vrefpx when the following device requires a large current from the output node Nout. In this embodiment, the bias voltages VG1 and VG2 are fixed, such as supply voltage VDD. In other embodiment, the bias voltages VG1 and VG2 can be set different.

Figure 9:
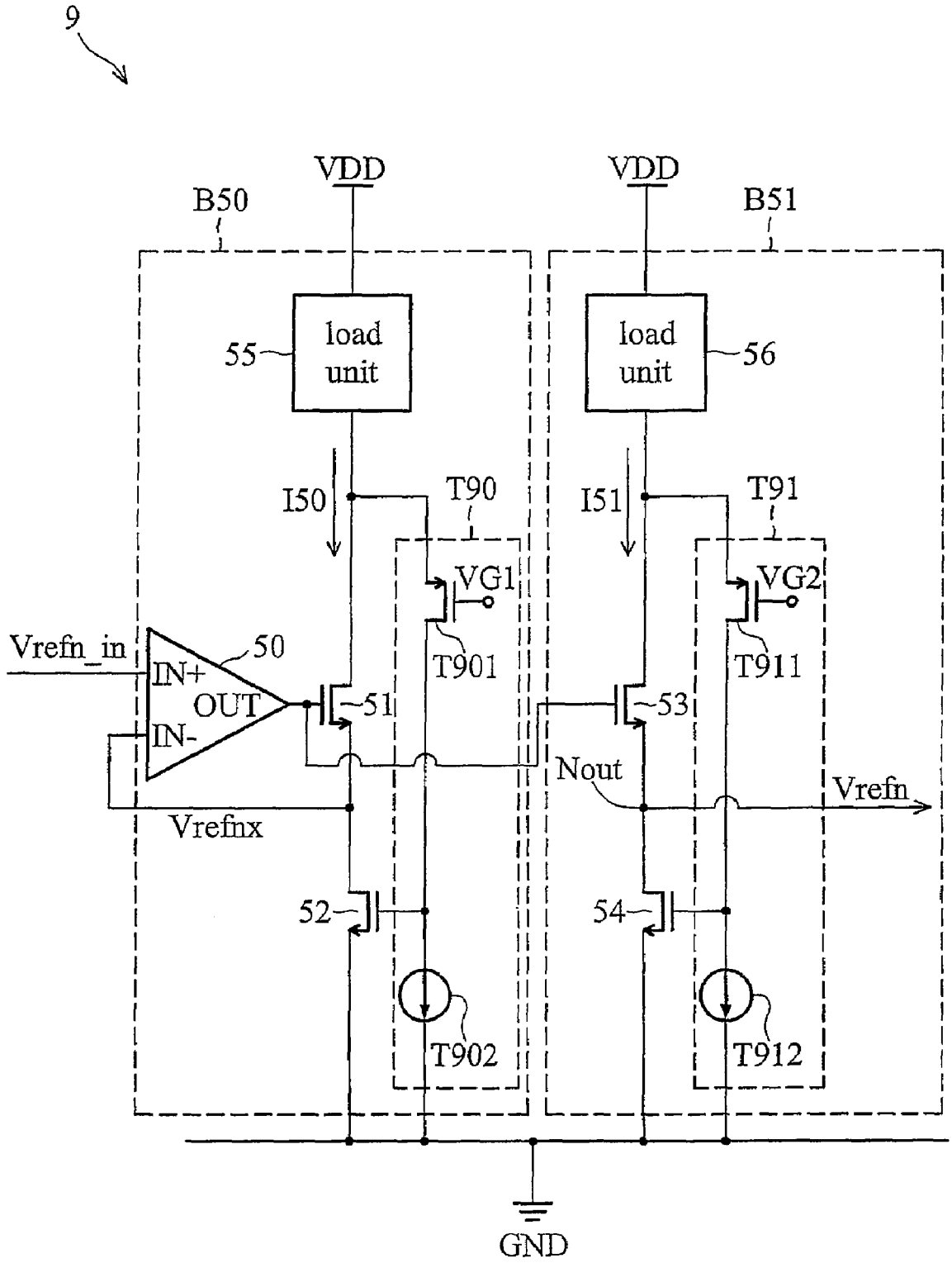
FIG. 9 shows another exemplary embodiment of a single-ended reference buffer circuit.

FIG. 9 shows another exemplary embodiment of a single-ended reference buffer circuit with greater current-driving capability. In a reference buffer circuit 9 in FIG. 9, a majority of the elements and the element connections are similar with the reference buffer circuit 5 of FIG. 5, and the connection between the gate of the NMOS transistor 54 and the drain of the NMOS transistor 53 and the connection between the gate of the NMOS transistor 52 and the drain of the NMOS transistor 51 are modified. Referring to FIG. 9, there are a tracking circuit T90 coupled between the gate of the NMOS transistor 52 and the drain of the NMOS transistor 51 and a tracking circuit T91 coupled between the gate of the NMOS transistor 54 and the drain of the NMOS transistor 53. The tracking circuit T90 comprises a tracking PMOS transistor T901 and a current source T902, and the tracking circuit T91 comprises a tracking PMOS transistor T911 and a current source T912. According to the above description, the voltage of the gate of the NMOS transistor 52 tracks the voltage of the drain of the NMOS transistor 51 through the PMOS transistor T901 and the voltage of the gate of the NMOS transistor 54 tracks the voltage of the drain of the NMOS transistor 53 through the PMOS transistor T911. Thus, the transistors 51 and 53 can operate in the saturation region when there is a current change at the output node Nout. The reference voltage Vrefn can also accurately track the reference voltage Vrefnx when a following device requires a large current from the output node Nout. In this embodiment, the bias voltages VG1 and VG2 are fixed, such as signal ground GND. In other embodiment, the bias voltages VG1 and VG2 can be set different.

Figure 10:
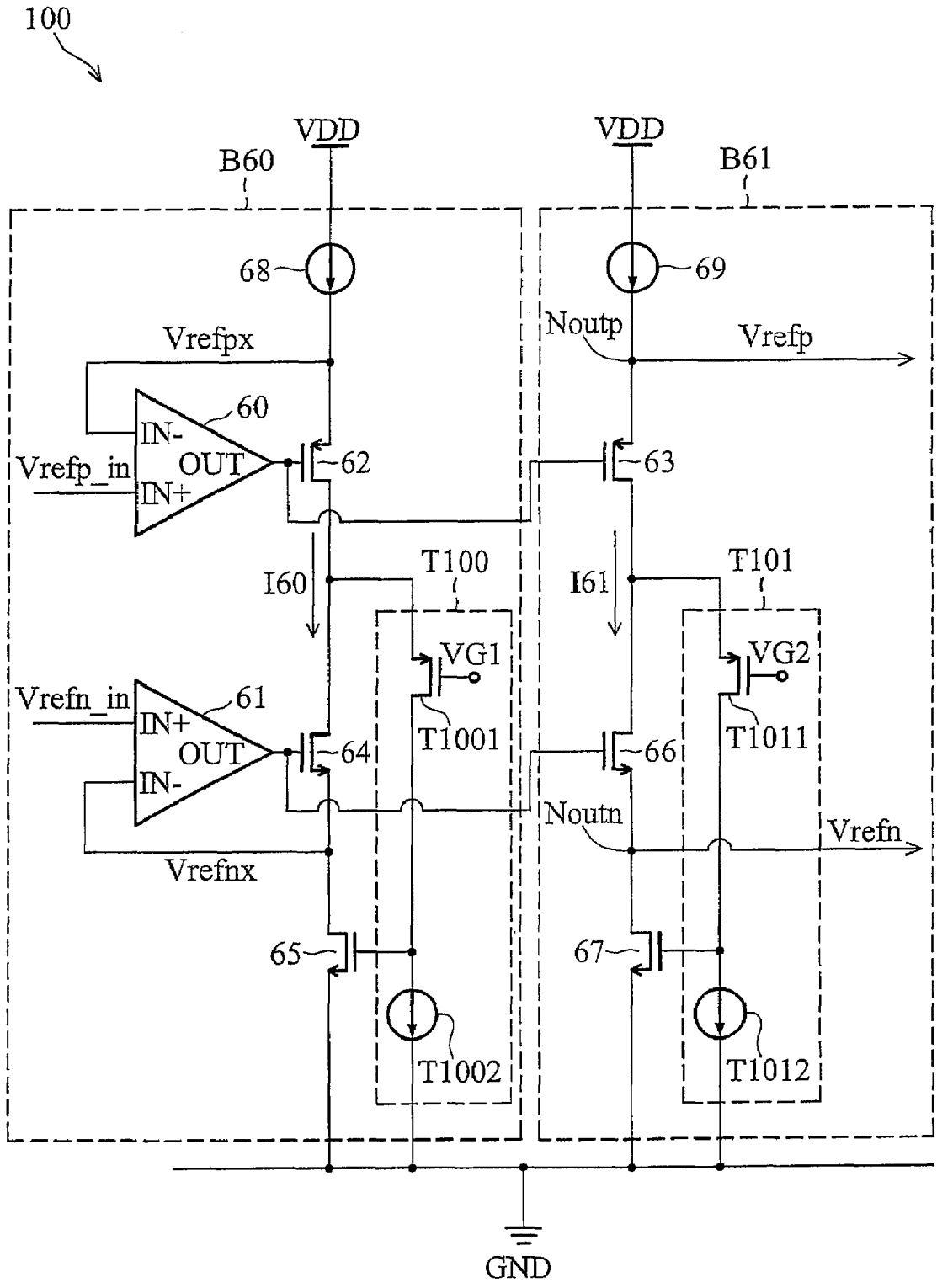
FIG. 10 shows another exemplary embodiment of a differential reference buffer circuit.

FIG. 10 shows another exemplary embodiment of a differential reference buffer circuit with greater current-driving capability. In a reference buffer circuit 100 in FIG. 10, a majority of the elements and the element connections are similar with FIG. 6, and the connection between the gate of the NMOS transistor 67 and the drain of the NMOS transistor 66 and the connection between the gate of the NMOS transistor 65 and the drain of the NMOS transistor 64 are modified. Referring to FIG. 10, there are a tracking circuit T100 coupled between the gate of the NMOS transistor 65 and the drain of the NMOS transistor 64 and a tracking circuit T101 coupled between the gate of the NMOS transistor 67 and the drain of the NMOS transistor 66. The tracking circuit T100 comprises a tracking PMOS transistor T1001 and a current source T1002, and the tracking circuit T101 comprises a tracking PMOS transistor T101 and a current source T1012. According to the above description, the voltage of the gate of the NMOS transistor 65 tracks the voltage of the drain of the NMOS transistor 64 through the PMOS transistor T1001, and the voltage of the gate of the NMOS transistor 67 tracks the voltage of the drain of the NMOS transistor 66 through the PMOS transistor T101. Thus, the transistors 64 and 66 can operate in the saturation region when there is a current change at the output node Noutp or Noutn. The reference voltages Vrefn and Vrefp can also accurately track the reference voltage Vrefnx and Vrefpx, respectively, when a following device requires a large current. In this embodiment, the bias voltages VG1 and VG2 are fixed, such as signal ground GND. In other embodiment, the bias voltages VG1 and VG2 can be set different.

Figure 11:
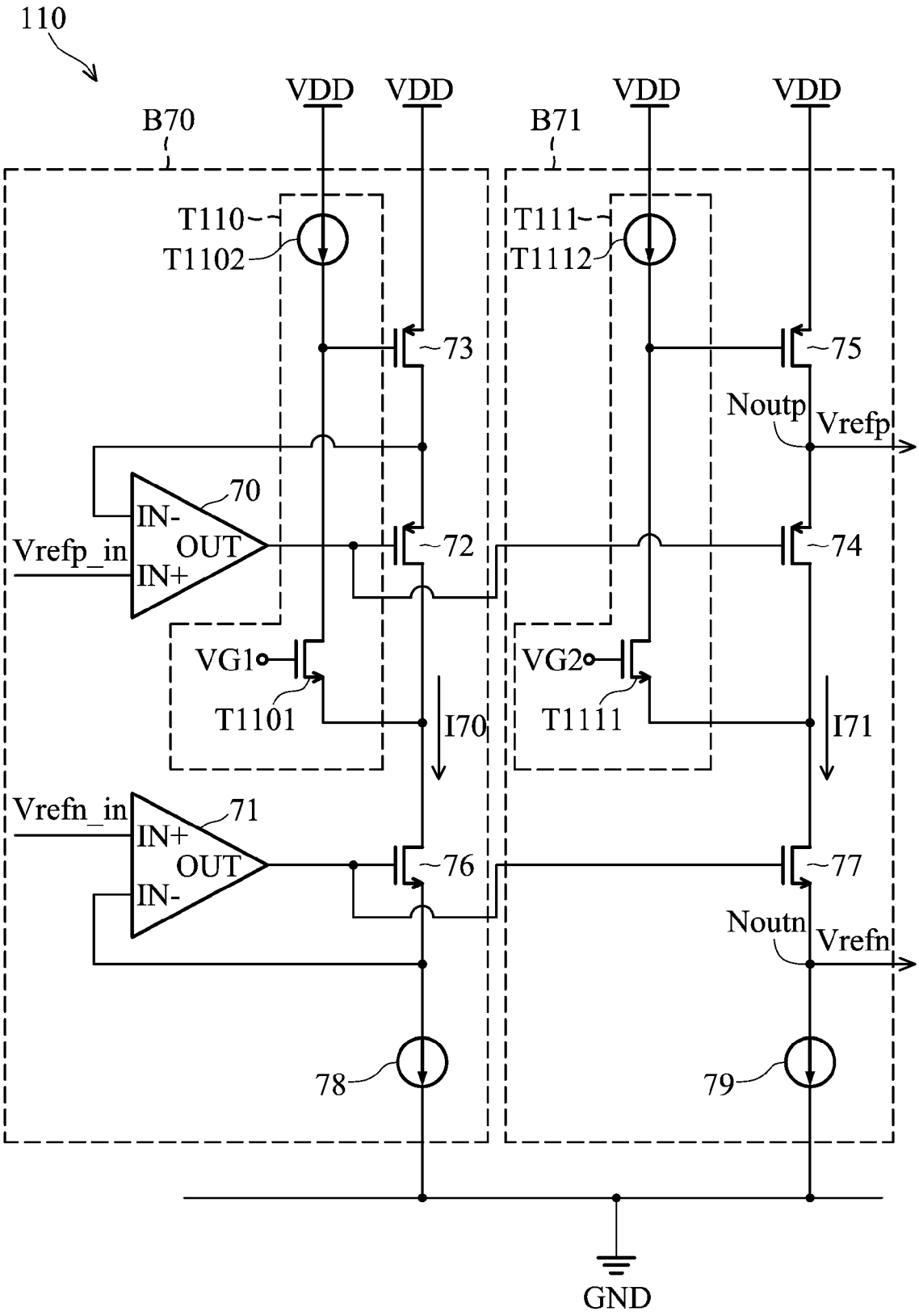
FIG. 11 shows another exemplary embodiment of a differential reference buffer circuit.

FIG. 11 shows another exemplary embodiment of a differential reference buffer circuit with greater current-driving capability. In a reference buffer circuit 110 in FIG. 11, a majority of the elements and the element connections are similar with FIG. 7, and the connection between the gate of the PMOS transistor 75 and the drain of the PMOS transistor 74 and the connection between the gate of the PMOS transistor 73 and the drain of the PMOS transistor 72 are modified. Referring to FIG. 11, there are a tracking circuit T110 coupled between the gate of the PMOS transistor 73 and the drain of the PMOS transistor 72 and a tracking circuit T111 coupled between the gate of the PMOS transistor 75 and the drain of the PMOS transistor 74. The tracking circuit T110 comprises a tracking NMOS transistor T1101 and a current source T1102, and the tracking circuit T111 comprises a tracking NMOS transistor T1111 and a current source T1112. According to the above description, the voltage of the gate of the PMOS transistor 73 tracks the voltage of the drain of the PMOS transistor 72 through the NMOS transistor T1101, and the voltage of the gate of the PMOS transistor 75 tracks the voltage of the drain of the PMOS transistor 74 through the NMOS transistor T1111. Thus, the transistors 72 and 74 can operate in the saturation region when there is a current change at the output node Noutp or Noutn. The reference voltages Vrefp and Vrefn can also accurately track the reference voltages Vrefpx and Vrefnx, respectively, when a following device requires a large current from the output node Noutp or Noutn. In this embodiment, the bias voltages VG1 and VG2 are fixed, such as supply voltage VDD. In other embodiment, the bias voltages VG1 and VG2 can be set different.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A reference buffer circuit for providing a reference voltage at an output node, comprising: a closed-loop branch comprising:

an amplifier having a positive input terminal for receiving an input voltage, a negative input terminal, and an output terminal;

a first metal oxide semiconductor (MOS) transistor having a gate coupled to the output terminal of the amplifier, a source coupled to the negative input terminal of the amplifier, and a drain;

a second MOS transistor coupled to the source of the first MOS transistor; and an open-loop branch comprising:

a third MOS transistor having a gate coupled to the output terminal of the amplifier, a source coupled to the output node, and a drain;

a fourth MOS transistor having a drain coupled to the source of the third MOS transistor, a source, and a gate; and a first tracking circuit arranged to make a voltage of the gate of the fourth MOS transistor track a voltage of the drain of the third MOS transistor;

wherein the closed-loop branch further comprises:

a second tracking circuit arranged to make a voltage of the gate of the second MOS transistor track a voltage of the drain of the first MOS transistor, wherein the second tracking circuit comprises:

a current source coupled between a voltage source and the gate of the second MOS transistor; and a fifth MOS transistor having a gate for receiving a bias voltage, a source coupled to the drain of the first MOS transistor, and a drain coupled to the gate of the second MOS transistor.

2. The reference buffer circuit as claimed in claim 1, wherein the first tracking circuit comprises:

a current source coupled between a voltage source and the gate of the fourth MOS transistor; and a fifth MOS transistor having a gate for receiving a bias voltage, a source coupled to the drain of the third MOS transistor, and a drain coupled to the gate of the fourth MOS transistor.

3. The reference buffer circuit as claimed in claim 2, wherein the first, second, third, and fourth MOS transistors are PMOS transistors, the fifth MOS transistor is an NMOS transistor, the voltage source is arranged to provide a supply voltage.

4. The reference buffer circuit as claimed in claim 2, wherein the first, second, third, and fourth MOS transistors are NMOS transistors, the fifth MOS transistor is a PMOS transistor, the voltage source is arranged to provide a signal ground.

5. The reference buffer circuit as claimed in claim 1 further comprising:

a first load unit coupled between the drain of the first MOS transistor and a voltage source;

a second load unit coupled between the drain of the third MOS transistor and the voltage source.

6. The reference buffer circuit as claimed in claim 5, wherein the first and second load units are implemented by transistors or resistors.

7. The reference buffer circuit as claimed in claim 1, wherein the fifth MOS transistor is an NMOS transistor when the first and second transistors are PMOS transistors, or the fifth MOS transistor is a PMOS transistor when the first and second transistors are NMOS transistors.

8. The reference buffer circuit as claimed in claim 1, wherein a current amount flowing through the open-loop branch is N times a current amount flowing through the closed-loop branch.

9. A reference buffer circuit for providing a reference voltage at an output node, comprising a closed-loop branch comprising:

an amplifier having a positive input terminal for receiving an input voltage, a negative input terminal, and an output terminal;

a source-follower transistor having a gate coupled to the output terminal of the amplifier, a source coupled to the negative input terminal of the amplifier, and a drain; and a first current transistor coupled to the source of the source-follower transistor; and an open-loop branch comprising:

a driving transistor having a gate coupled to the output terminal of the amplifier, a source coupled to the output node, and a drain;

a second current transistor having a drain coupled to the source of the driving transistor, a source, and a gate;

a first current source coupled to the gate of the second current transistor; and a first tracking transistor having a gate for receiving a bias voltage, a source coupled to the drain of the driving transistor, and a drain coupled to the gate of the second current transistor.

10. The reference buffer circuit as claimed in claim 9, wherein when the source-follower transistor and the driving transistors are PMOS transistors, the first and second current transistors act as current sources, and when the source-follower transistor and the driving transistor are NMOS transistors, the first and second current transistors act as current sinks.

11. The reference buffer circuit as claimed in claim 9, wherein a current amount flowing through the open-loop branch is N times a current amount flowing through the closed-loop branch.

12. A reference buffer circuit for providing a first reference voltage at a first output node and a second reference voltage at a second output node, comprising:

a closed-loop branch comprising:

a first amplifier having a positive input terminal for receiving a first input voltage, a negative input terminal, and an output terminal;

a second amplifier having a positive input terminal for receiving a second input voltage, a negative input terminal, and an output terminal;

a first metal oxide semiconductor transistor having a gate coupled to the output terminal of the first amplifier, a source coupled to the negative input terminal of the first amplifier, and a drain;

a second MOS transistor having a gate coupled to the output terminal of the second amplifier, a source coupled to the negative input terminal of the second amplifier, and a drain coupled to the drain of the first MOS transistor; and a third MOS transistor coupled to the source of the second MOS transistor; and an open-loop branch comprising:

a fourth MOS transistor having a gate coupled to the output terminal of the first amplifier, a source coupled to the first output node, and a drain;

a fifth MOS transistor having a gate coupled to the output terminal of the second amplifier, a source coupled to the second output node, and a drain coupled to the drain of the fourth MOS transistor;

a sixth MOS transistor having a drain coupled to the source of the fifth MOS transistor, a source, and a gate; and a first tracking circuit arranged to make a voltage of the gate of the sixth MOS transistor track a voltage of the drain of the fifth MOS transistor.

13. The reference buffer circuit as claimed in claim 12, wherein the first tracking circuit comprises:

a current source coupled between a voltage source and the gate of the sixth MOS transistor; and a seventh MOS transistor having a gate for receiving a bias voltage, a source coupled to the drain of the fifth MOS transistor, and a drain coupled to the gate of the sixth MOS transistor.

14. The reference buffer circuit as claimed in claim 13, wherein the first and fourth MOS transistors are PMOS transistors, the second, third, fifth, and sixth MOS transistors are NMOS transistors, the voltage source is arranged to provide a signal ground.

15. The reference buffer circuit as claimed in claim 13, wherein the first and fourth MOS transistors are NMOS transistors, the second, third, fifth, and sixth MOS transistors are PMOS transistors, the voltage source is arranged provide a supply voltage.

16. The reference buffer circuit as claimed in claim 12 further comprising:

a first current source coupled between a voltage source and the source of the first MOS transistor; and a second current source coupled between the voltage source and the source of the fourth MOS transistor.

17. The reference buffer circuit as claimed in claim 16, wherein the first and second current sources are implemented by transistors.

18. The reference buffer circuit as claimed in claim 12, wherein the closed-loop branch further comprises:

a second tracking circuit arranged to make a voltage of the gate of the third MOS transistor tracks a voltage of the drain of the second MOS transistor.

19. The reference buffer circuit as claimed in claim 18, wherein the second tracking circuit comprises:

a current source coupled between a voltage source and the gate of the third MOS transistor; and a seventh MOS transistor having a gate receiving a bias voltage, a source coupled to the drain of the second MOS transistor, and a drain coupled to the gate of the third MOS transistor.

20. The reference buffer circuit as claimed in claim 19, wherein the seventh MOS transistor is an NMOS transistor when the second and third are PMOS transistors, or the seventh MOS transistor is a PMOS transistor when the second and third are NMOS transistors.

21. The reference buffer circuit as claimed in claim 12, wherein a current amount following through the open-loop branch is N times a current amount flowing through the closed-loop branch.

22. A reference buffer circuit for providing a first reference voltage at a first output node and a second reference voltage at a second output node, comprising:

a closed-loop branch comprising:

a first amplifier having a positive input terminal for receiving a first input voltage, a negative input terminal, and an output terminal;

a second amplifier having a positive input terminal for receiving a second input voltage, a negative input terminal, and an output terminal;

a first source-follower transistor having a gate coupled to the output terminal of the first amplifier, a source coupled to the negative input terminal of the first amplifier, and a drain;

a second source-follower transistor having a gate coupled to the output terminal of the second amplifier, a source coupled to the negative input terminal of the second amplifier, and a drain coupled to the drain of the first source-follower transistor; and a first current transistor coupled to the source of the second source-follower transistor; and an open-loop branch comprising:

a first driving transistor having a gate coupled to the output terminal of the first amplifier, a source coupled to the first output node, and a drain;

a second driving transistor having a gate coupled to the output terminal of the second amplifier, a source coupled to the second output node, and a drain coupled to the drain of the first driving transistor;

a second current transistor coupled to the source of the second driving transistor;

a first current source coupled to the gate of the second current transistor; and a first tracking transistor having a gate for receiving a bias voltage, a source coupled to the drain of the second driving transistor, and a drain coupled to the gate of the second current transistor.

23. The reference buffer circuit as claimed in claim 22, wherein when the first source-follower transistor and the first driving transistor are PMOS transistors and the second source-follower transistor and the second driving transistor are NMOS transistors, the first and second current transistors act as current sinks; when the first source-follower transistor and the first driving transistor are NMOS transistors and the second source-follower transistor and the second driving transistor are PMOS transistors, the first and second current transistors act as current sources.

24. The reference buffer circuit as claimed in claim 22, wherein a current amount flowing through the open-loop branch is N times a current amount flowing through the closed-loop branch.

25. A reference buffer circuit for providing a reference voltage at an output node, comprising: a closed-loop branch comprising:

an amplifier having a positive input terminal for receiving an input voltage, a negative input terminal, and an output terminal;

a first metal oxide semiconductor (MOS) transistor having a gate coupled to the output terminal of the amplifier, a source coupled to the negative input terminal of the amplifier, and a drain; and a second MOS transistor coupled to the source of the first MOS transistor; and an open-loop branch comprising:

a third MOS transistor having a gate coupled to the output terminal of the amplifier, a source coupled to the output node, and a drain;

a fourth MOS transistor having a drain coupled to the source of the third MOS transistor, a source, and a gate; and a first tracking circuit arranged to make a voltage of the gate of the fourth MOS transistor track a voltage of the drain of the third MOS transistor.

26. The reference buffer circuit as claimed in claim 25, wherein first tracking circuit comprises a level shifter arranged to shift a voltage of the gate of the fourth MOS transistor to a voltage of the drain of the third MOS transistor.

27. The reference buffer circuit as claimed in claim 25, wherein the first tracking circuit is independent from the close-loop branch.

* * * * *